US006871367B1

(12) United States Patent
Beckles et al.

(10) Patent No.: US 6,871,367 B1
(45) Date of Patent: Mar. 29, 2005

(54) COMBINATION BED AND BATHING DEVICE

(76) Inventors: Michael Beckles, 350 Lefferts Ave. Apt. 2E, Brooklyn, NY (US) 11225; Naomi Safe'Zapata, 350 Lefferts Ave. Apt. 2E, Brooklyn, NY (US) 11225

( * ) Notice: Subject to any disclaimer, the term of this patent is extended or adjusted under 35 U.S.C. 154(b) by 651 days.

(21) Appl. No.: 10/015,231

(22) Filed: Dec. 12, 2001

(51) Int. Cl.[7] ..... A61G 7/047; A61G 7/00; A61H 33/00

(52) U.S. Cl. ..... 5/606; 5/611; 5/423; 4/547

(58) Field of Search ..... 5/606, 604, 611, 5/424, 2.1, 423; 4/547

(56) References Cited

U.S. PATENT DOCUMENTS 4,074,370 A * 2/1978 Harmony, III ..... 4/545
4,631,762 A * 12/1986 Fugett ..... 5/605
5,054,136 A 10/1991 Inagaki ..... 4/546
5,173,978 A 12/1992 Kassai et al. ..... 5/600
5,386,599 A 2/1995 Cartwright ..... 4/547
5,666,677 A * 9/1997 Crawford et al. ..... 4/540

* cited by examiner

*Primary Examiner*—Alexander Grosz
(74) *Attorney, Agent, or Firm*—Goldstein Law Offices, P.C.

(57) ABSTRACT

A combination bed and bathing device designed for bathing patients and individuals who may suffer varying degrees of impairment or immobility due to illness, injury or other conditions, which may render these individuals incapable of adequately conducting personal hygiene, including a bed frame. A mattress portion is adjustably coupled with the bed frame. The mattress portion is adjustable vertically with respect to the bed frame. A water container is coupled with the bed frame. The water container has an open upper end and a closed lower end. The open upper end has a rigid perforated netting secured therein. A sliding pad is coupled with the water container. The sliding pad covers the open upper end of the water container in a covered orientation. The sliding pad has a removable central section.

7 Claims, 5 Drawing Sheets

COMBINATION BED AND BATHING DEVICE

BACKGROUND OF THE INVENTION

The invention relates to a combination bed and bathing device designed for bathing patients and individuals who may suffer varying degrees of impairment or immobility due to illness, injury or other conditions, which may render these individuals incapable of adequately conducting personal hygiene.

The main problem confronting caregivers in caring for the aged and infirmed involves the bathing process. For this reason, merely wiping and cleaning the body are resorted to instead of taking a bath since this can be done safely in the home. However, with such wiping and cleaning, it is difficult to obtain the same effect as taking a bath. As a result, the dirt of a patient is accumulated, and their muscles and the like sometimes result in atrophy. What is needed is an easy way to properly bathe a person confined to his/her bed.

The present invention attempts to solve the abovementioned problem by providing a combination bed and bathing device that will effectively facilitate the proper bathing and grooming of a patient.

Several references show various combination bed devices. U.S. Pat. No. 5,054,136 to Inagaki discloses a patient's bed with a slidable mounted bath tub in the lower portion. U.S. Pat. No. 5,173,978 to Kassai discloses a bed with a vertically collapsible bathtub assembly capable of being stored under the bed. U.S. Pat. No. 5,386,599 to Cartwright discloses a portable sofa and bathing device.

While these units may be suitable for the particular purpose employed, or for general use, they would not be as suitable for the purposes of the present invention as disclosed hereafter.

SUMMARY OF THE INVENTION

It is an object of the invention to produce a combination bed and bathing device designed for bathing patients and individuals who may suffer varying degrees of impairment or immobility due to illness, injury or other conditions, which may render these individuals incapable of adequately conducting personal hygiene including a bed frame having a generally rectangular configuration. A mattress portion is adjustably coupled with the bed frame. The mattress portion is adjustable vertically with respect to the bed frame. The mattress portion comprises one half of the bed frame. The mattress portion includes a containment belt extending horizontally across an upper surface thereof. A water container is coupled with the bed frame. The water container comprises one half of the bed frame. The water container has an open upper end and a closed lower end. The open upper end has a rigid perforated netting secured therein. The closed lower end has a drain. The water container includes a track extending from the open upper end down an outside thereof. A sliding pad is coupled with the water container. The sliding pad is slidably disposed within the track of the water container. The sliding pad covers the open upper end of the water container in a covered orientation. The sliding pad has a removable central section. A water hose is coupled with the bed frame. The water hose is connectable with a water source. The water hose has an adjustable spray nozzle. A heating unit is coupled with the bed frame. The heating unit includes a hose extending outwardly therefrom. The hose has an adjustable head. A control panel is coupled with the bed frame. The control panel is in communication with the mattress portion, the water hose and the heating unit.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

It will be noted in the various figures that the device relates to a combination bed and bathing device designed for bathing patients and individuals who may suffer varying degrees of impairment or immobility due to illness, injury or other conditions, which may render these individuals incapable of adequately conducting personal hygiene. In its broadest context, the device consists of a bed frame, a mattress portion, a water container, a sliding pad, a water hose, a heating unit and a control panel. Such components are individually configured and correlated with respect to each other so as to attain the desired objective.

The bed frame 12 has a generally rectangular configuration. The bed frame 12 is similar in appearance to standard bed frames. Optionally, the bed-frame 12 could be provided with cylindrical collars for holding IV poles in a secure manner.

Figure 1:
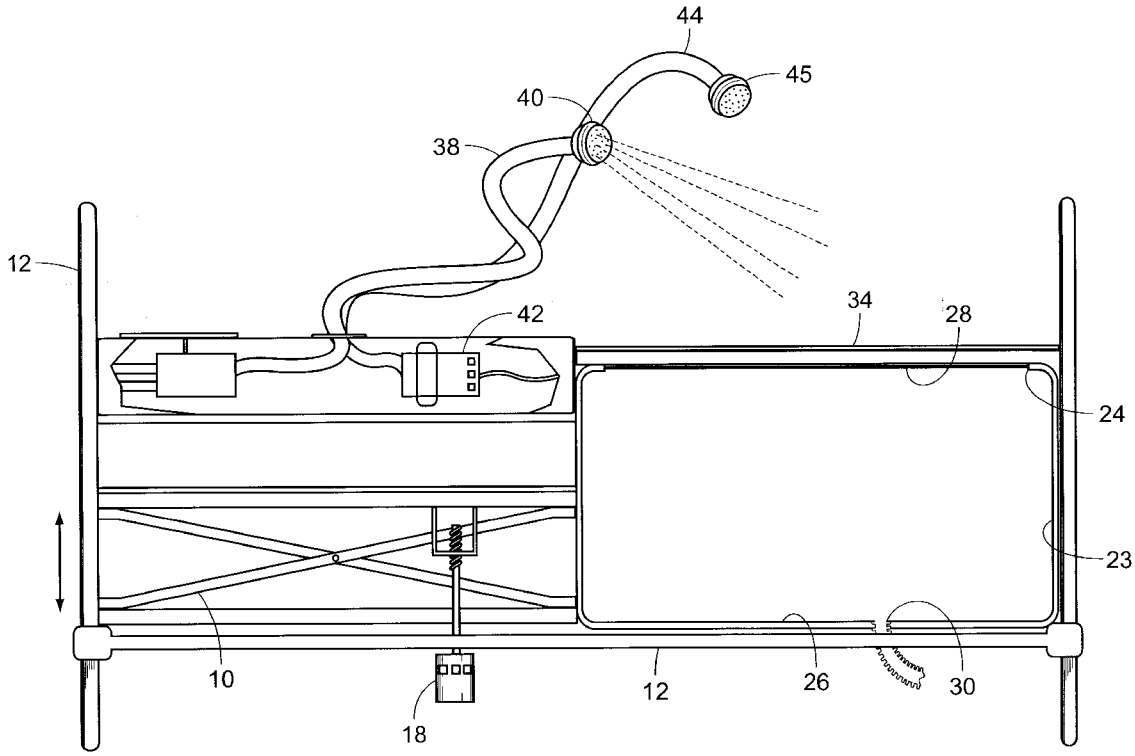
FIG. 1 is an elevated end view of the present invention shown in cross-section.
Figure 2:
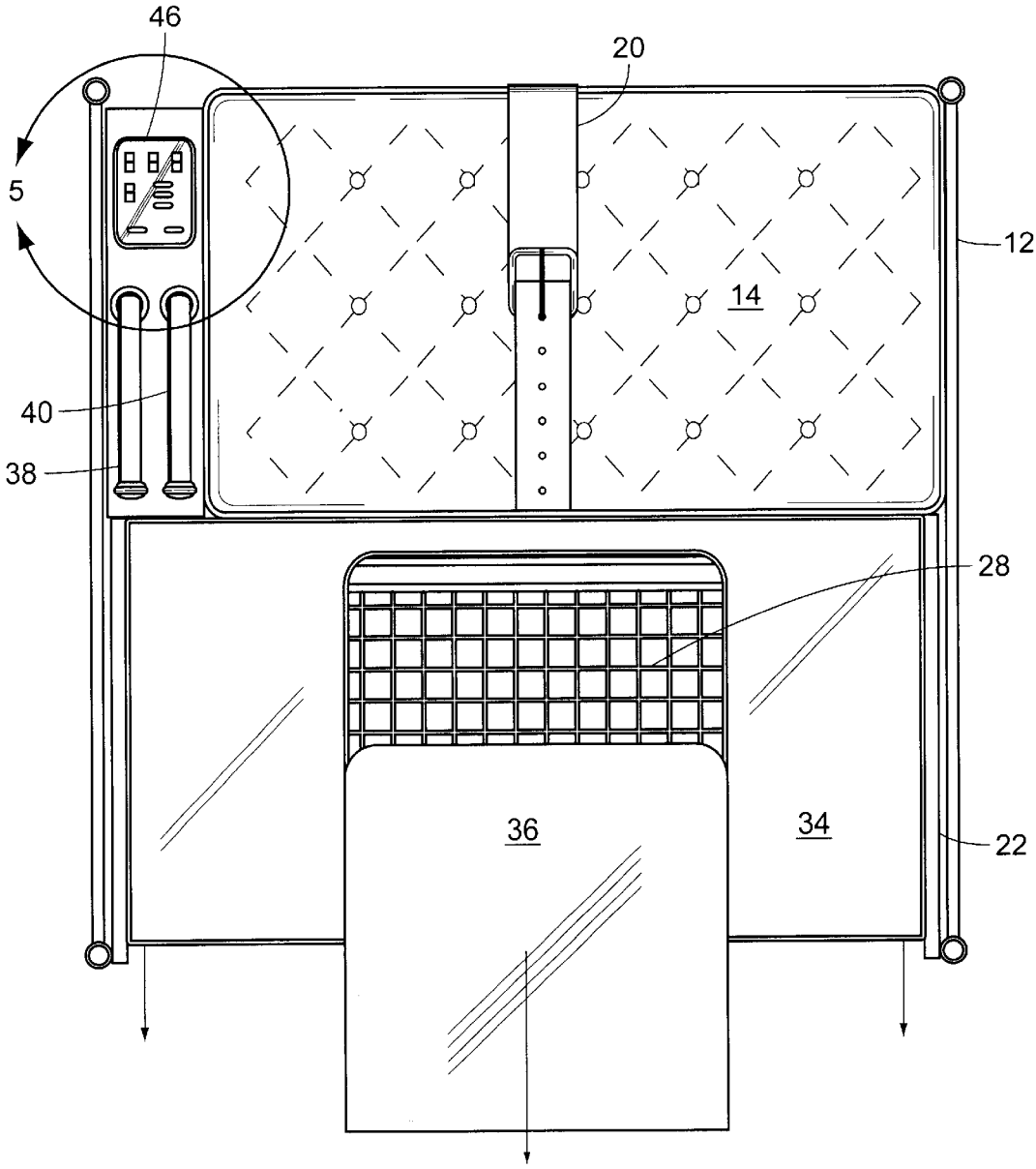
FIG. 2 is a top plan view of the present invention illustrating the removable central section of the removable pad.
Figure 3:
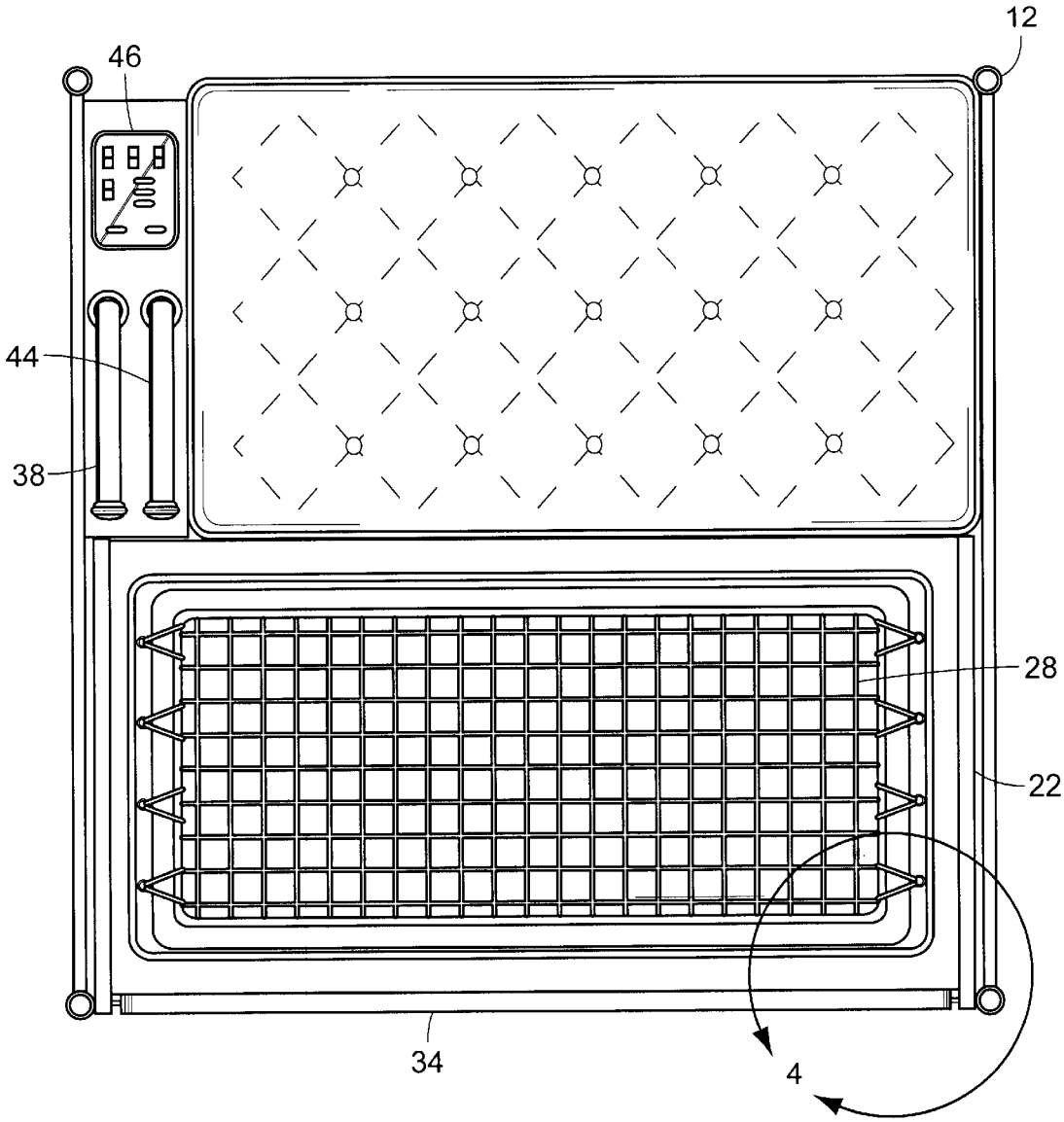
FIG. 3 is a top plan view of the present invention illustrated with the removable pad removed.
Figure 4:
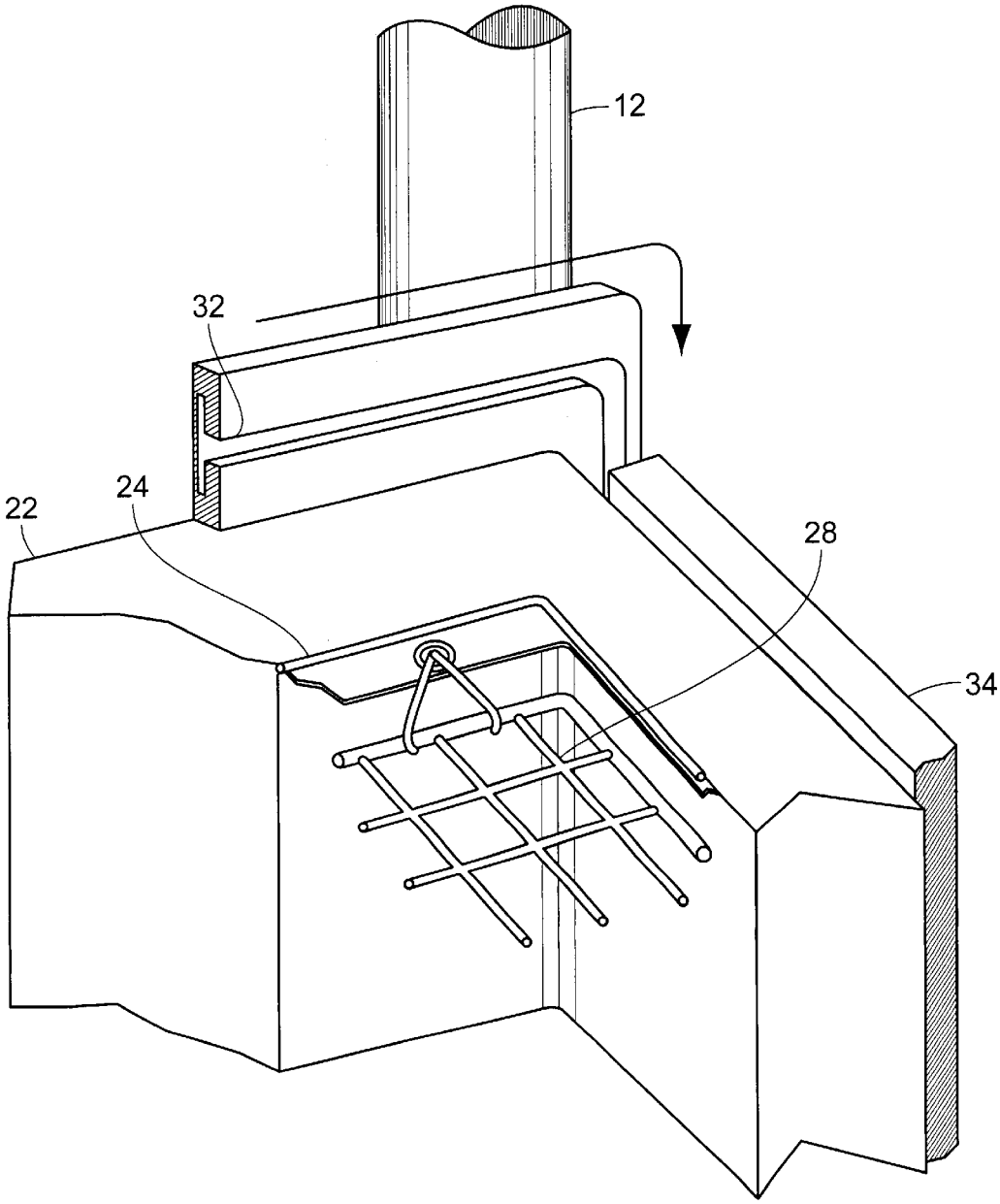
FIG. 4 is a sectional perspective view of the present invention illustrating the removal of the removable pad.
Figure 5:
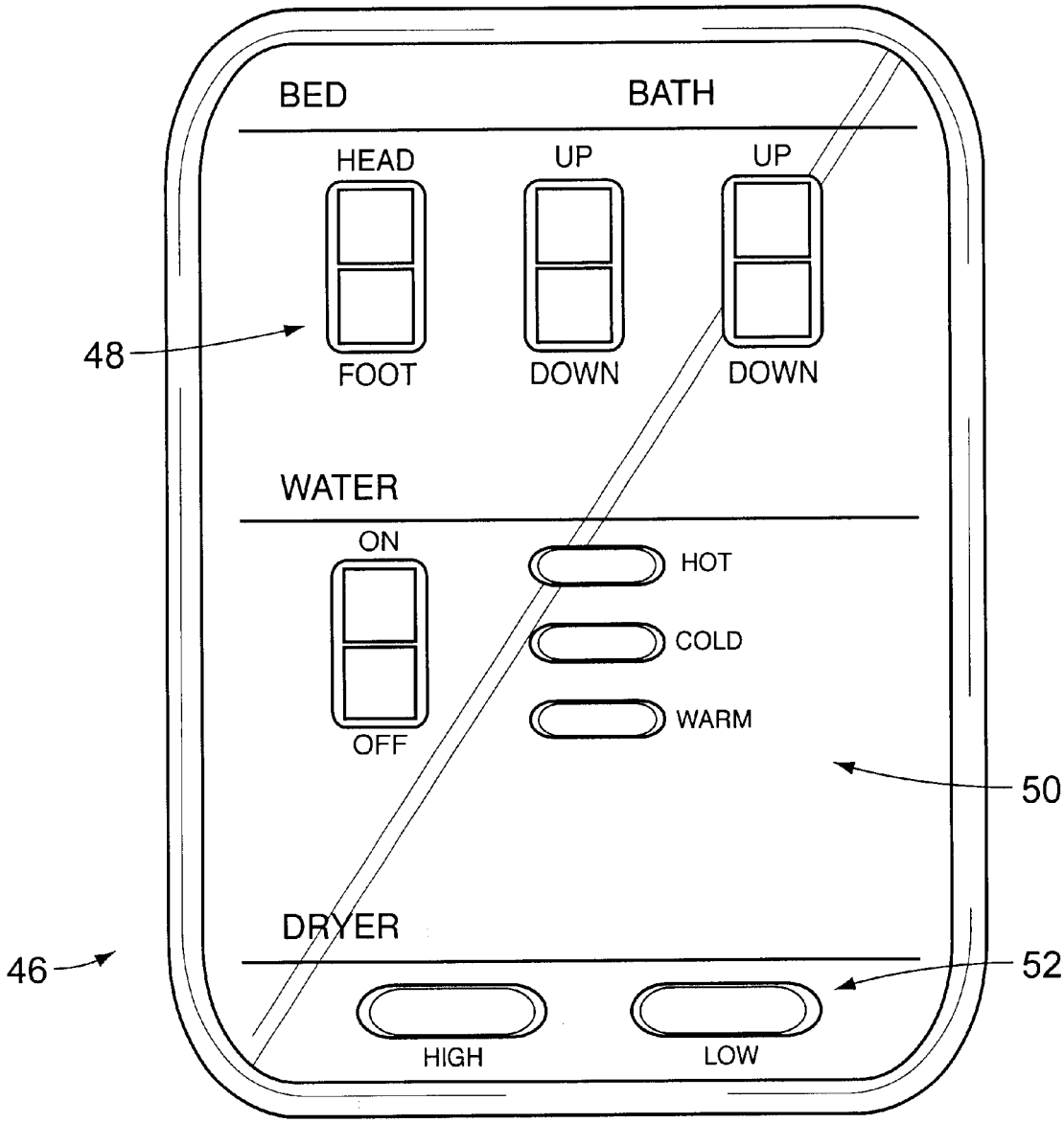
FIG. 5 is a plan view of the control panel of the present invention.

The mattress portion 14 is adjustably coupled with the bed frame 12. The mattress portion 14 is adjustable vertically with respect to the bed frame 12. Note FIG. 1. The mattress portion 14 is supported on a scissor platform 10 with a corresponding motor 18 that allows the mattress portion 14 to raise and lower as needed. The mattress portion 14 comprises one half of the bed frame 12. The mattress portion 14 includes a containment belt 20 extending horizontally across an upper surface thereof.

The water container 22 is coupled with the bed frame 12. The water container 22 comprises one half of the bed frame 12. The water container 22 has an open upper end 24 and a closed lower end 26. The open upper end 24 has a rigid perforated netting 28 secured therein. The closed lower end 26 has a drain 30. The water container 22 includes a track 32 extending from the open upper end 24 down an outside thereof. The netting 28 will support a person thereon.

The sliding pad 34 is coupled with the water container 22. The sliding pad 34 is slidably disposed within the track 32 of the water container 22. The sliding pad 34 covers the open upper end 24 of the water container 22 in a covered orientation. The sliding pad 34 has a removable central section 36. The sliding pad 34 will cover the netting 28 when the water container 22 is not in use. The central section 36 can be removed when only the perineal area of a person is being washed.

The water hose 38 is coupled with the bed frame 12. The water hose 38 is connectable with a water source. The water hose 38 has an adjustable spray nozzle 40. The water hose 38 allows a person sitting or laying on the netting 28 to be washed with the excess water falling into the water container 22.

The heating unit 42 is coupled with the bed frame 12. The heating unit 42 includes a hose 44 extending outwardly therefrom. The hose 44 has an adjustable head 45. The heating unit 42 can be used to dry off the person after they have been washed.

The control panel 46 is coupled with the bed frame 12. The control panel 46 is in communication with the mattress portion 47, the water hose 38 and the heating unit 42. The control panel including mattress control buttons 48 that allow the mattress portion 14 to be raised and lowered, both the head and foot portions thereof. The control panel 46 includes water control buttons 50 that allow the water to be turned off and on as well as control the water temperature. The control panel 46 includes heating control buttons 52 that control the flow of heat through the hose 44 thereof.

What is claimed is:

1. A combination bed and bathing device designed for bathing patients and individuals who may suffer varying degrees of impairment or immobility due to illness, injury or other conditions, which may render these individuals incapable of adequately conducting personal hygiene, comprising, in combination:

a bed frame having a generally rectangular configuration;

a mattress portion adjustably coupled with the bed frame, the mattress portion being adjustable vertically with respect to the bed frame, the mattress portion comprising one half of the bed frame, the mattress portion including a containment belt extending horizontally across an upper surface thereof;

a water container coupled with the bed frame, the water container comprising one half of the bed frame, the water container having an open upper end and a closed lower end, the open upper end having a rigid perforated netting secured therein, the closed lower end having a drain, the water container including a track extending from the open upper end down an outside thereof;

a sliding pad coupled with the water container, the sliding pad being slidably disposed within the track of the water container, the sliding pad covering the open upper end of the water container in a covered orientation, the sliding pad having a removable central section;

a water hose coupled with the bed frame, the water hose being connectable with a water source, the water hose having an adjustable spray nozzle;

a heating unit coupled with the bed frame, the heating unit including a hose extending outwardly therefrom, the hose having an adjustable head; and a control panel coupled with the bed frame, the control panel being in communication with the mattress portion, the water hose and the heating unit.

2. A combination bed and bathing device designed for bathing patients and individuals who may suffer varying degrees of impairment or immobility due to illness, injury or other conditions, which may render these individuals incapable of adequately conducting personal hygiene, comprising, in combination:

a bed frame;

a mattress portion adjustably coupled with the bed frame, the mattress portion being adjustable vertically with respect to the bed frame;

a water container coupled with the bed frame, the water container having an open upper end and a closed lower end, the open upper end having a rigid perforated netting secured therein;

a laterally sliding pad, adapted to cover and uncover the water container, coupled with the water container, the sliding pad covering the open upper end of the water container in a covered orientation, the sliding pad having a removable central section.

3. The combination bed and bathing device as set forth in claim 2, wherein the mattress portion includes a containment belt extending horizontally across an upper surface thereof.

4. The combination bed and bathing device as set forth in claim 2, wherein the water container including a track extending from the open upper end down an outside thereof for receiving the sliding pad.

5. The combination bed and bathing device as set forth in claim 2, and further including a water hose coupled with the bed frame, the water hose being connectable with a water source, the water hose having an adjustable spray nozzle.

6. The combination bed and bathing device as set forth in claim 2, and further including a heating unit coupled with the bed frame, the heating unit including a hose extending outwardly therefrom, the hose having an adjustable head.

7. The combination bed and bathing device as set forth in claim 2, and further including a control panel coupled with the bed frame.

* * * * *